United States Patent [19]

Gibbs

[11] Patent Number: 4,683,824

[45] **Date of Patent: * Aug. 4, 1987**

[54] CARTRIDGE LAUNCHED - DISK DEPLOYED CHAFF

[76] Inventor: Robert L. Gibbs, 2255 Winter Pkwy., Cuyahoga Falls, Ohio 44221

[ * ] Notice: The portion of the term of this patent subsequent to May 8, 2001 has been disclaimed.

[21] Appl. No.: 665,502

[22] Filed: Oct. 29, 1984

Related U.S. Application Data

[63] Continuation of Ser. No. 451,014, Jan. 26, 1983, abandoned, which is a continuation-in-part of Ser. No. 334,597, Dec. 28, 1981, Pat. No. 4,446,793.

[51] Int. Cl.[4] ..... F42B 13/42; F42B 5/16

[52] U.S. Cl. ..... 102/436; 102/438; 102/504; 102/505; 89/1.51

[58] Field of Search ..... 102/505, 504, 436, 438; 89/1.5 R

[56] References Cited

U.S. PATENT DOCUMENTS

| | | | |
|---|---|---|---|
| 3,308,759 | 3/1967 | Sorenson | 102/505 X |
| 3,741,125 | 6/1973 | La Pointe | 102/505 |
| 3,896,732 | 7/1975 | Schaffer | 102/436 |
| 4,028,701 | 6/1977 | Parks et al. | 343/18 C |
| 4,175,469 | 11/1979 | Ritland et al. | 89/1 B |
| 4,183,302 | 1/1980 | Schillreff | 102/505 X |
| 4,446,793 | 5/1984 | Gibbs | 102/505 |

FOREIGN PATENT DOCUMENTS

| | | | |
|---|---|---|---|
| 3048621 | 7/1982 | Fed. Rep. of Germany | 102/505 |

OTHER PUBLICATIONS

*Exploratory Development of Disc Deployed Chaff,* by M. T. Systems, Inc., Nov. 1981.

*Primary Examiner*—Deborah L. Kyle
*Assistant Examiner*—Michael J. Carone
*Attorney, Agent, or Firm*—L. A. Germain

[57] ABSTRACT

A cartridge launched spin stabilized disk for deploying chaff (radar countermeasure dipoles) or other expendable materials or substances from a moving aircraft. The disk, containing the expendable material is ejected from the aircraft at some elevation angle and at an angle in azimuth off of the aircraft line-of-flight and dispenses the expendable material in a more or less uniform fashion for a brief period of time as it travels away from the aircraft.

9 Claims, 4 Drawing Figures

CARTRIDGE LAUNCHED - DISK DEPLOYED CHAFF

This is a continuation of application Ser. No. 451,014 filed Jan. 26, 1983 now abandoned which is a continuation-in-part of application Ser. No. 334,597 filed Dec. 28, 1981 now issued to U.S. Pat. No. 4,446,793 on May 8, 1984.

FIELD OF INVENTION

This invention generally relates to the field of passive electronic countermeasures and more specifically to apparatus for deploying expendable materials such as chaff from a moving aircraft.

BACKGROUND OF THE INVENTION

Heretofore, chaff materials have been deployed from moving aircraft by one of the following five methods:

(a) Near instantaneous ejection of a clump(s) of dipoles from a plastic cartridge into the adjacent airstream by pyrotechnic or pneumatic means.

(b) Ejecting the contents of a box of chaff by mechanically tearing open the box in the presence of ram air which is exhausted outside of the aircraft or external store structure.

(c) Releasing dipoles into a ram air environment from between two layers of film of synthetic resin composition. The chaff package is stored under tension in roll form and as the roll is mechanically unwound, the dipoles are released from between the film layers into the ram airstream for ejection into the boundary layer of the aircraft or external store.

(d) Dipoles may be released from a forward-fired rocket in one or more bursts at some distance ahead of the aircraft and at a predetermined interval as applicable. Individual bursts occur nearly instantaneously and are pyrotechnically actuated.

(e) Firing a chaff loaded bullet from an on-board gun. Chaff contained in the bullet is conveyed to a point 3,000 to 5,000 feet from the aircraft and released Regardless of the release method utilized, chaff dipoles tend to stop their forward progress very rapidly when released into the airstream due to their low mass and relatively high drag. For said methods (a) and (b) this results in a small chaff cloud forming well aft of the rapidly moving aircraft. For said method (c) the dipole stream is continuous but it does not reach significant width and height dimensions until it is some distance aft of the aircraft. Forward fired rockets can seed chaff clouds ahead of the aircraft which may grow to significant size by the time the aircraft and chaff cloud share the same radar resolution cell and may therefore be effective. This method is very costly, however, and requires the use of an otherwise valuable external stores station for the rocket launcher pod and delays aircraft evasive maneuvers after launch of the rocket. Said method (c) also normally requires a stores station to carry the payload and dispensing mechanism. Said method (e) releases the chaff too far from the aircraft to be effective.

The predominant method in use for tactical aircraft self protect purposes is the nearly instantaneous ejection of clumps of dipoles into the adjacent airstream in accordance with method (a). The dispensing mechanism for this method takes up a minimum of space and pyrotechnic ejection is reliable and safe. With such a system, approximately one third of a pound of various length chaff dipoles are placed in the aircraft boundary layer in approximately 6 to 8 milliseconds. Dipoles from the ejected clumps peel off layer by layer until all that remains is a saturated cloud of dipoles 1 ½ to 2 meters in width and height and 10 to 12 meters in length. Initial formation of the cloud takes approximately 200 milliseconds. At aircraft velocities on the order of 800 feet per second, cloud formation takes place well aft of the airplane with a maximum cross section of about four square meters when viewed on a radial run.

This invention provides apparatus for ejecting a similar quantity of dipoles which imparts a vector to the chaff cloud transverse to the aircraft line of flight. This is accomplished by ejecting the dipoles which are encased in a spin stabilized payload disk from an ejection cartridge. As a disk travels it emits dipoles in a substantially continuous manner. By ejecting the spinning disk at an angle with respect to the aircraft line-of-flight (90 degrees for example) and releasing dipoles as it moves outwardly, a significant increase in cloud size is achieved while still in the vicinity of the launching aircraft. Relatively minor modification to existing dispenser systems will permit their use with the rectangular cartridge configuration required for this invention. The self-protect ability of the system is enchanced by the rapid chaff cloud formation and its greater size when viewed on a radial run.

This invention provides apparatus for ejecting a spin stabilized payload disk and for emitting chaff dipoles or other materials from the disk case.

The following patents are cited as the most pertinent prior art of which the applicant is aware.

| U.S. Pat. No. | Name | Date |
|---|---|---|
| 3,027,047 | F. M. Johnson | 3-27-62 |
| 3,137,231 | F. M. Johnson | 6-16-64 |
| 3,765,336 | R. J. Kulsik | 10-16-73 |
| 4,178,854 | G. H. Schillreff | 12-18-79 |
| 4,183,302 | G. H. Schillreff | 1-15-80 |

Accordingly, this invention provides (a) an expendable payload disk for the distribution of microwave or optically reflective materials in the near vicinity of an aircraft; (b) a means for ejecting the payload disk from an aircraft; (c) a means for arraying chaff or other materials in a direction containing a significant vector outward from an aircraft line-of-flight; and (d) a means to release chaff dipoles or other type material at a substantially uniform rate for a short period of time upon separation from the aircraft.

DETAILED DESCRIPTION OF INVENTION

Figure 1:
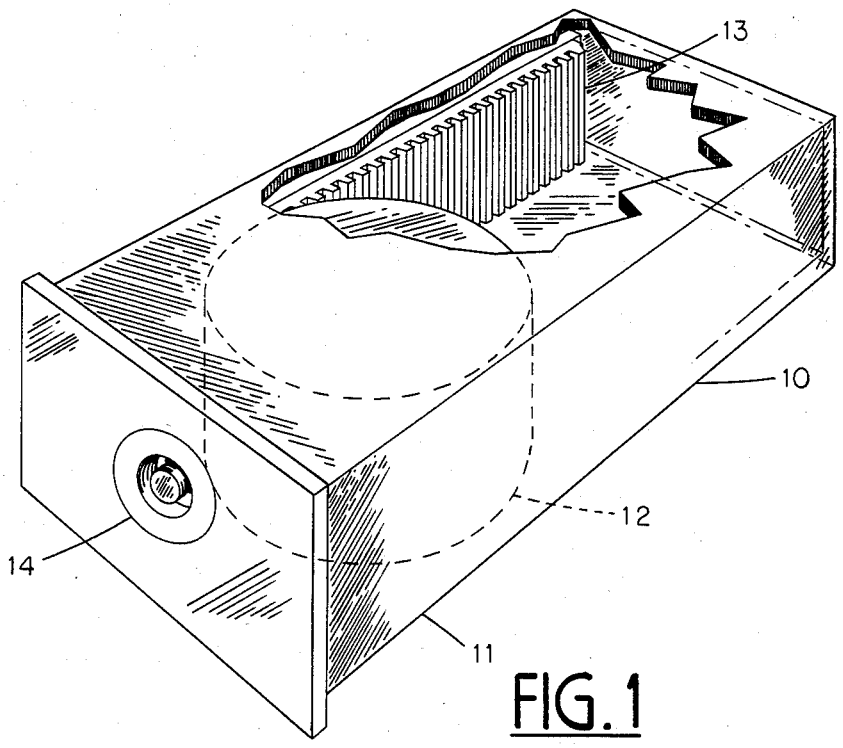
FIG. 1 is a perspective view, partially broken away, illustrating a first embodiment of the present invention.

Referring to FIG. 1 of the drawings, a loaded rectangular cartridge 10 is shown which comprises a thin walled cartridge case 11, a payload disk 12, a rack segment 13 and an impulse cartridge 14. The payload disk 12 is substantially circular and may be made of plastic or metallic material and includes a plurality of spur gear teeth positioned at least a portion of the way around its periphery. These teeth mesh with those of the rack segment 13 which runs substantially full length of the cartridge case 11 and along one of its sides. The opposite side and the upper and lower surfaces of the cartridge case 11 maintain alignment and engagement of the teeth between the disk case 12 and the rack segment 13 as clearly evident in FIG. 2. The cartridge case 11 and the rack segment 13 may be of plastic, metallic or other suitable material. Dimensional tolerances must be held closely so as to provide a minimum gap for passage of gas pressure between the disk 12, the rack segment 13 and the inner surfaces of the walls of the cartridge case 11. This condition must be held regardless of the location of the disk 12 within the cartridge case 11. The disk 12 however, must be capable of rotational and linear movement within the cartridge case 11 as a result of the application of a few pounds of force. The cartridge case 11 is open at the end opposite the impulse cartridge 14.

Figure 2:
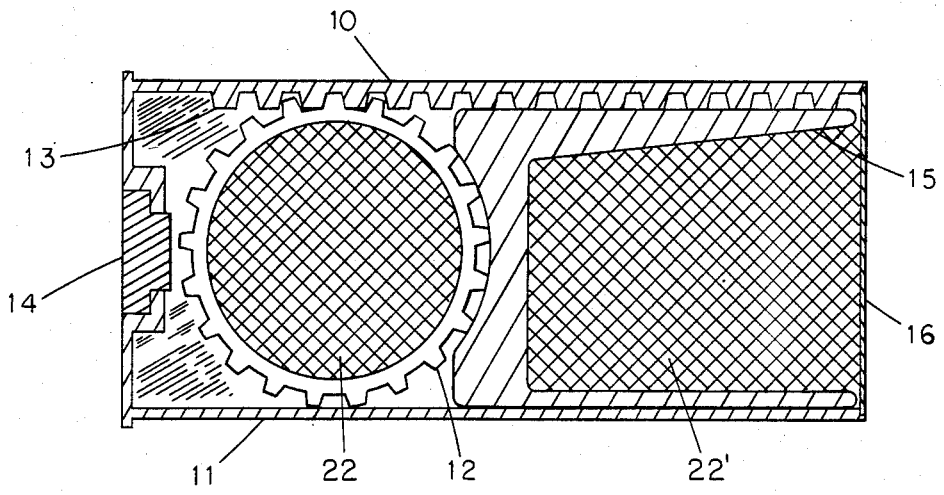
FIG. 2 is an exposed top view illustrating a second emobidment of the invention.

FIG. 2 shows a second embodiment wherein a disk 12 is loaded into the rectangular cartridge case 11 and includes an optional piston 15 positioned between the disk 12 and an end cap 16. Alignment of the piston 15 is maintained by the teeth surface plane of the rack segment 13 and the upper, lower and opposite side surfaces of the cartridge case 11. The piston 15 may be of plastic, metallic or other material type. The end cap 16 may be lightly bonded to the cartridge case 11 or it may be held in place by a snap-in feature designed into the configuration of the cartridge case 11.

Figure 3:
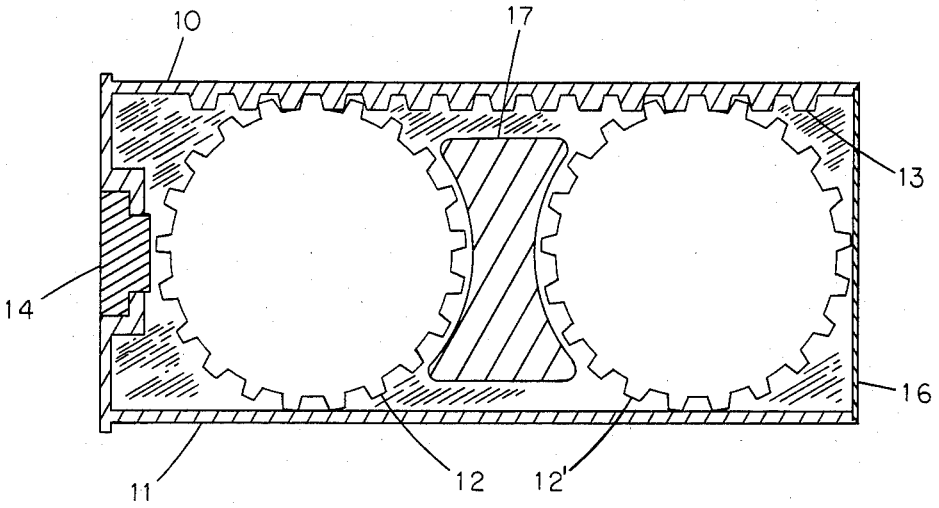
FIG. 3 is an exposed top view, similar to FIG. 2 illustrating another element of the invention.

FIG. 3 shows multiple disks 12 loaded into the rectangular cartridge case 11. The disks 12 are separated by an interface block 17 which may be of plastic, metallic or other type of material.

Figure 4:
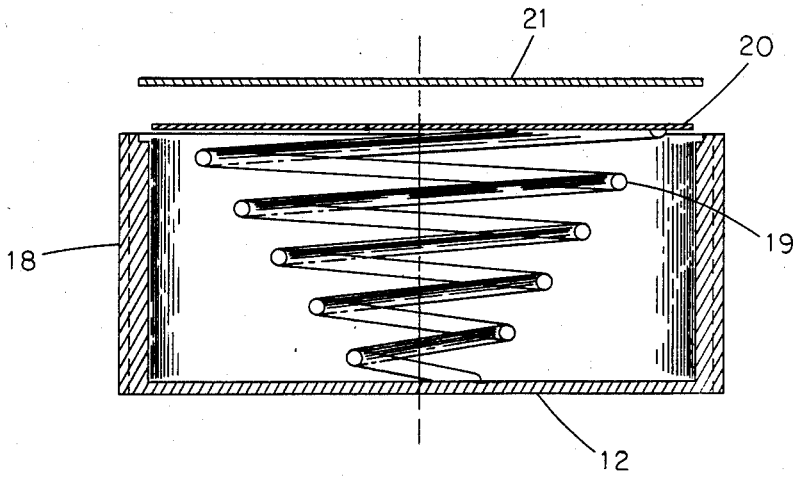
FIG. 4 is an elevational view, in partial section, showing the various members which comprise a payload disk forming a primary element of the invention.

FIG. 4 is a partial cross-section of a disk 12 which comprises a cylindrical case 18, a spiral wound spring 19, a payload tray 20, and a disk lid 21. The spiral wound spring 19 is designed to be compressed such that its compressed height is equal to or slightly greater than the outside diameter of the spring steel (music) wire used in its fabrication. The payload tray 20 is a thin flat disc with an outside diameter somewhat less than the inside diameter of the case 18. When the spiral spring 19 is fully compressed, the payload tray 20 is inserted into the disk case 18 and a chaff payload 22 is inserted on top of the payload tray 20 to the level of the upper edge of the disk case 18. The disk lid 21 is placed on top of the chaff payload providing closure of the disk case 18. The disk 12 is inserted into the cartridge case 11. The payload tray 20 and the disk lid 21 may be of plastic, metallic or other material such as cardboard. The disk lid 21 is not bonded or otherwise fastened to the disk case 18 but is retained in position by the upper and lower surfaces of the cartridge case 11 when the disk 12 is inserted into the cartridge case 11. A further modification for other types of payloads may involve substitution of a second disk lid in place of the bottom surface of the disk case 18. In this embodiment, the disk case 18 will be open at both ends and a payload will be dispensed from either or both ends as the lids 21 separate from the disk case 18 upon ejection from the cartridge case 11.

In operation, a disk loaded rectangular cartridge 10 is placed into a dispenser block located on or in an aircraft or aircraft external store prior to take off. The dispenser block and its installation and electronics are not part of this invention. The dispenser block assembly retains the cartridge case 11, provides a firing pulse as appropriate to the impulse cartridge 14 and provides a physical restraint against expansion of the four walls of the cartridge case 11 when the impulse cartridge 14 is detonated. Normal orientation is at an angle with respect to the aircraft line-of-flight. This angle is frequently as much as 90 degrees or more in azimuth and may include an elevational angle. For the purpose of the utilization of the disk loaded rectangular cartridge 10, any angle off the aircraft line-of-flight may be used.

As clearly illustrated in FIG. 1, a chamber is formed by the walls of the cartridge case 11, including the end having an impulse cartridge 14. At the opposite end of this chamber, a boundary is formed by a disk 12. In operation, detonation of the impulse cartridge 14 raises the chamber pressure by several hundred pounds per square inch in a substantially instantaneous manner. This gas pressure forces the disk 12 to accelerate rapidly toward the open end of the cartridge case 11. Simultaneously, the peripheral teeth of the disk 12 (which are engaged with the teeth of the fixed rack segment 13) imparts a rapid rotational acceleration to the disk 12. The disk 12 clears the exit plane of the cartridge case 11 within a few milliseconds exhibiting relatively high linear and rotational velocities. The lightly retained end cap 16 is forced out of the cartridge case 11 either by the rapid build-up of internal gas pressure or by impact of the rapidly accelerating disk 12. Build-up of the gas pressure working against the end cap 16 is the sum of detonation pressures slipping past the disk 12 and of increased pressure as existing gases in the chamber between the disk 12 and the end cap are compressed as the disk 12 rapidly approaches the end cap 16.

FIG. 2 shows an embodiment wherein a piston 15 is positioned in the space between the disk 12 and the end cap 16. The piston 15 is in contact with the disk 12 and is also in contact with each end of the end cap 16. As the disk 12 accelerates toward the end cap 16 the restraint provision of the end cap 16 to cartridge case 11 is overcome by the piston 15. For all embodiments of the disk loaded rectangular cartridge 10, the primary payload indicated at 22 is contained in the disk 12. For the embodiment illustrated in FIG. 2, additional payloads 22' may be stored in the chamber provided between the piston 15, the end cap 16 and the remaining two walls of the cartridge case 11. In the case of payloads of chaff material (radar countermeasures dipoles) this chamber permits utilization of longer dipoles (covering lower frequencies) than does the disk case 12.

A third embodiment is shown in FIG. 3 wherein a second disk 12' is positioned within the cartridge case 11. An interface block 17 is placed between the two disk units 12 and 12'. The second disk 12' is in static contact with the end cap 16. Detonation of the impulse cartridge 14 causes both disk units, the interface block 17 and the end cap 16 to exit from the cartridge case 11. Transfer of linear exit forces between the disk units 12, 12' is achieved through low frictional sliding contact between the interface block 17 and the disk units. The component geometries and the forces involved maintains alignment of the interface block 17 thereby accommodating the linear transfer of forces between the disk units 12 and 12'.

For most embodiments, the disk 12 is as depicted in FIG. 4. The cross-sectional showing of the disk 12 shows a substantially cylindrical disk case 18 having full height external peripheral teeth. In its static position, the loaded disk 12 is installed in the cartridge case 11 with its teeth engaged by the teeth of the rack segment 13. Upon detonation of the impulse cartridge 14, linear force vectors of the gas pressure cause the disk 12 and its payload to exit the cartridge case 11 with usable linear and rotational vectors. Immediately upon exiting the cartridge case 11, the spiral wound spring 19 raises the payload tray 20, the payload 22 and the disk lid 21 toward the open end of the disk case 18. The disk lid 21 is immediately blown away by the airstream and the payload is deployed by the centrifugal rotational forces of the disk case 18 and by the encountered airstream. When a payload comprises chaff dipoles, deployment of the various elements of the total payload are substantially continuous as the lifting action of the spiral wound spring 19 raises successive layers of payload elements sufficiently so that they clear the edge of the disk case 18. Total time for deployment of an entire payload is on the order of several hundred milliseconds. This time increment may be varied by: variations in payload loading arrangement; the strength of the spiral wound spring 19; variations in the airstream velocities to which the disk case 18 is exposed; and by other factors including variations in payload characteristics such as chaff material type (aluminum foil or aluminum coated fiberglass, etc.) dipole slip coat finish, etc. For some payload types the spiral wound spring 19, the payload tray 20 and the disk lid 21 may not be required. For some payload applications, the inner, peripheral surface of the disk case 18 may be tapered with a progressively increasing diameter toward its open end. This geometry will aid centrifugal forces in payload deployment.

For some applications the disk case 18 lower surface may be eliminated and a second disk lid 21 substituted. In this configuration, payload elements may be deployed from both open ends of the disk case 18 cylinder.

For the embodiment which utilizes the piston 15 (reference FIG. 2), the payload elements are pushed out of the cartridge case 11 by the piston 15 and immediately deployed in an aft direction caused by the airstream passing the dispenser block exit plane. Virtually no vector transverse to the aircraft line-of-flight is imparted to payload elements of the chaff dipole type. The payload elements contained in the disk 12 however are released at various distances outboard of the aircraft flight axis as the spin stabilized disk 12 moves away from the aircraft. This provides for more rapid and widespread dispersal of the payload with greater radar cross section response from the resultant chaff cloud during the first several hundred milliseconds after dispersal. Variations in the density or mass of the disk case 18 may also be incorporated to optimize the payload deployment pattern.

While certain representative embodiments and details have been shown for the purpose of illustrating the invention, it will be apparent to those skilled in the art that other variations are possible For example wrapping groups of dipoles in mylar strips before loading; using string ball dipoles for the payload; use of aerosol payloads; use of retroreflective devices for the payload; and/or use of three or more disks in an elongated cartridge. In addition, this invention may be applied to surface vehicles such as ships or tanks. Accordingly, the scope of the invention is considered to be determined by the appended claims

What is claimed is:

1. A spin stabilized disk having an axis of rotation which is perpendicular to its line-of-travel upon being ejected from a launching device to release a payload of radiation interference material comprises:

a substantially cylindrical disk case having a closed end, an open end, and a plurality of gear teeth about at least a portion of its external circumferential surface which teeth effect imparting of rotational forces to the disk case upon being launched;

a payload of radiation interference material within the disk case; and payload ejection means positioned within the disk case between the closed end and the payload to effect ejection of the payload upon the disk being launched

2. The spin stabilized disk as set forth in claim 1; wherein the payload ejection means comprises a substantially thin, circular disk positioned adjacent the payload, between the payload and the closed end, and a spring positioned between the circular disk and the closed end, said spring having multiple coil turns of differing diameters such that upon being compressed by the presence of the payload in the disk case its total height is substantially the height of a single coil turn.

3. Apparatus for effecting ejection of a payload of radiation interference material into the atmosphere comprising in combination:

(A) a substantially rectangular cartridge case having a closed end, an opposite open end, and parallel side walls the surface of one of which carries at least a portion of a lineal length of rack tooth means, said closed end including an impulse means to explosively pressurize the cartridge case upon being ignited; and (B) at least one payload carrying disk positioned within the cartridge case and movable along its length from the closed end to the open end, said disk means having an axis of rotation perpendicular to the length of the cartridge case and comprising:

(a) a substantially cylindrical disk case having a closed end, an open end, and a plurality of gear teeth about at least a portion of its external circumferential surface for engagement with the rack tooth means within the cartridge case such as to impart rotation of the disk case as it moves within the cartridge case;

(b) a payload of radiation interference material mounted within the disk case; and (c) payload ejection means positioned within the disk case between the closed end and payload to effect ejection of the payload upon the disk case being launched from the cartridge case by the explosive ignition of the impulse means.

4. The apparatus as set forth in claim 3 wherein at least two payload carrying disks are mounted within the cartridge case.

5. The apparatus as set forth in claim 3 wherein a payload carrying disk is mounted within the cartridge case toward the closed end thereof and a piston is mounted between said disk and the open end of the cartridge case, said cartridge case also including a means for sealing its open end.

6. The apparatus as set forth in claim 5 wherein the piston is adapted for carrying a payload of radiation interference material.

7. The apparatus as set forth in claim 3 wherein the payload ejection means comprises:

a substantially thin, circular disk positioned adjacent the payload, between said payload and the closed end of the disk case; and a spring positioned between the circular disk and the closed end, said spring being compressed by the presence of a payload in the disk case such that upon the disk case being launched from the cartridge case the payload, and the circular disk are ejected from the disk case.

8. The apparatus as set forth in claim 7 wherein the spring comprises multiple coil turns of differing diameters such that upon being compressed by the presence of a payload in the disk case its total height is substantially the height of a single coil turn.

9. The apparatus as set forth in claim 3 wherein the disk case is open at both of its ends and the payload occupies the full volume enclosed by the cylindrical walls of the disk case.

* * * * *